US008176998B2

(12) United States Patent
Brostöm

(10) Patent No.: US 8,176,998 B2
(45) Date of Patent: May 15, 2012

(54) METHOD AND DEVICE FOR CORE DRILLING

(75) Inventor: Johan Brostöm, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 12/737,154

(22) PCT Filed: Jun. 8, 2009

(86) PCT No.: PCT/SE2009/000289

§ 371 (c)(1),
(2), (4) Date: Dec. 13, 2010

(87) PCT Pub. No.: WO2009/157837

PCT Pub. Date: Dec. 30, 2009

(65) Prior Publication Data

US 2011/0079432 A1 Apr. 7, 2011

(30) Foreign Application Priority Data

Jun. 27, 2008 (SE) ..... 0801522

(51) Int. Cl.
*E21B 47/01* (2006.01)
*E21B 7/00* (2006.01)
*E21B 10/02* (2006.01)

(52) U.S. Cl. ..... 175/40; 175/244; 175/246

(58) Field of Classification Search ..... 175/40, 175/44, 244, 246
See application file for complete search history.

(56) References Cited

U.S. PATENT DOCUMENTS

| | | | | |
|---|---|---|---|---|
| 3,637,038 | A | 1/1972 | Tanner | |
| 3,735,338 | A | 5/1973 | Aldrich et al. | |
| 5,339,915 | A * | 8/1994 | Laporte et al. | 175/244 |
| 5,984,009 | A | 11/1999 | DiFoggio | |
| 6,019,181 | A | 2/2000 | Soinski et al. | |
| 6,343,649 | B1 | 2/2002 | Beck et al. | |
| 6,588,505 | B2 | 7/2003 | Beck et al. | |
| 6,708,784 | B1 | 3/2004 | Borg | |
| 7,424,920 | B2 | 9/2008 | Bergstrand et al. | |
| 2004/0256152 | A1 | 12/2004 | Dashevskiy et al. | |
| 2005/0269081 | A1 | 12/2005 | Rose | |
| 2006/0124310 | A1 * | 6/2006 | Lopez de Cardenas et al. | 166/313 |

FOREIGN PATENT DOCUMENTS

| | | | |
|---|---|---|---|
| EP | 0228134 | A2 | 7/1987 |
| EP | 0552087 | A2 | 7/1993 |
| GB | 2424916 | A | 10/2006 |
| SE | 524767 | | 9/2004 |

* cited by examiner

*Primary Examiner* — Brad Harcourt
(74) *Attorney, Agent, or Firm* — Mark P. Stone

(57) ABSTRACT

A method in core drilling, wherein a tubular drill bit (8) being arranged at the end of a tubular drill string (6) is driven under rotation against a material intended for drilling, and wherein for the purpose of core retrieving, a tool (17, 20) is brought inside the drill string to an operative position in the area of the drill bit. Acoustic vibrations (24, 25) from the drill string are sensed when the tool is brought to its operative position, sensed acoustic vibrations are analysed for detecting the occurrence of acoustic vibrations characteristic for when the tool has reached its operative position, and an output signal is emitted when the occurrence of vibrations characteristic of when the tool has reached its operative position has been detected. The invention also concerns a device and a drill rig.

20 Claims, 4 Drawing Sheets

METHOD AND DEVICE FOR CORE DRILLING

FIELD OF THE INVENTION

The invention concerns a method and a device for core drilling according to the preambles of claims 1 and 11 respectively. The invention also concerns a drill rig including such a device.

BACKGROUND OF THE INVENTION

Core drilling is used for performing different types of rock technological investigations, wherein a drill core is being drilled, picked up from the drill hole and analysed for different properties, mineral contents etc. Core drilling is an important function for the investigation and evaluation of a rock body, and the result of the core drilling is often the basis for decisions of great economic importance such as if, for example, an ore body is to be exploited or not.

In a previously known procedure for core drilling, a tubular, abrasive, drill bit which is arranged at the end of a tubular drill string is rotated against the rock intended for sampling. When drilling has been performed a certain determined distance, the drill string contains a correspondingly long drill core, which, after interrupting the rotational movement, is pulled up out of the drill string for analysis etc.

In respect of a normal core drilling procedure, it is drilled in the order between two and five meters before a drill core is picked up from the drill string.

In a previously known core drilling equipment, a core retrieving pipe is used, which during active drilling is positioned adjacent to the drill bit for receiving the drill core produced through the drilling. The core retrieving tube has the character of being an inner pipe inside the drill string and comprises, at the end which is turned away from the drill bit, engagement means for the co-operation with a catch tool, which after a completed drilling period is introduced into the drill string all the way to the core retrieving pipe, in order to be connected thereto in a operative position, whereupon the catch tool with connected core retrieving tube and a drill core being firmly held inside, can be pulled out from the drill string.

Core drilling is often performed at very great distances from the drill rig, in particular at great depths such as for example depths of 3000 m. At such great distances, the time for lowering of the core retrieving pipe and the time for lowering of the catch tool take considerable amounts of time. Also in respect of essentially shorter drilling distances, some hundreds of meters, lowering of these tools is a considerable part of the total operation time of the drill rig.

In respect of today's core drilling procedures, it is to a great extant up to the individual operator to determine when the core retrieving pipe and the catch tool respectively have reached their respective operative positions. This is had through i.a. control and observation of the equipment in different ways in order to determine when the respective tool has reached its respective operative position. Since the environment at a drill rig for core drilling is noisy and subjected to outside uncontrollable circumstances, experience has shown that it is difficult for the operator to determine when the respective tool has reached its operative position and thereby when the next step for operating the rig is to be initiated.

For that reason it is very common that the operator as a safety measure continues a lowering function such as flushing with flushing fluid against their respective tool, a long period of time after that the tool in fact has reached its operative position. This procedure of course contributes to the operational safety but can be economically very disadvantageous, since the total operational economy of the rig is essentially impaired with reduced production as a consequence.

Another aspect is that initiating the next step in a core drilling process before a tool (the core retrieving pipe or the catch tool) has reached it operative position results in erroneous function, possibly stop of operation and in any case an extended process.

AIM AND MOST IMPORTANT FEATURES OF THE INVENTION

It is an aim of the invention to overcome these disadvantages and to provide a method and a device for core drilling which results in fast and safe determining that the next operative step can be initiated for the drill.

According to the invention this is achieved through the features of the characterized portion of the respective independent claim. The fact is that it has shown that it is possible to distinguish the acoustic vibrations that occur when the respective tool has reached its respective operative position (hereby is intended with tool: the core retrieving pipe and the catch tool), from other acoustic vibrations that prevail during the operation. This has resulted in that it can be quickly detected with great security when the respective operative position has been reached, whereupon, without unnecessary delay, the next step can be initiated in the process. An output signal from the system with the significance that occurrence of vibrations characteristic of when the tool has reached its operative position has been detected, can be used for informing the operator about the situation or directly switch the rig into the next step in the process.

By the acoustic vibrations from the drill string being sensed over a machine part which is connected to the drill string, because of the vibrations then being transferred essentially unchanged between the machine parts, an adequate uncomplicated sensor element can be placed on a suitable, for example protected and accessible, position, for example on the feed beam or on a feed beam holder.

Signals received from sensing the acoustic vibrations are suitably compared with signals stored in a memory which are generated through any one from the group: tests and/or calculations, wherein it can be the question of field tests completed with calculations for different tools for different applications. Hereby it is the question of frequency analysis and in particular vibration pattern analysis.

In particular, the tool is a tubular core retrieving tool in the form of a core retrieving pipe which is brought into a drill string into an operative position adjacent to the drill bit, positioned during drilling for core reception. Hereby are intended vibrations characteristic of the tool reaching its operative position, vibrations emanating from when the core retrieving pipe reaches a position stop in the drilling position.

In particular, also, the tool is a catch tool, intended to be brought into an operative position where it is connected to the core retrieving pipe, for retrieving this with a firm held drill core from the drilling position after completed drilling. Hereby the catch tool with connected core retrieving pipe is pulled out of the drill string for bringing out the drill core. Vibrations characteristic for when the catch tool has reached its operative position are vibrations emanating from when it comes into engagement with the core retrieving pipe.

The output signal is preferably used for one or more from the group: interrupting a step for flushing down a tool (shutting down a water pump-drive motor), start drilling, pulling up of a catch tool, producing a signal to be perceived by an operator.

Preferably a time period from initiating that a tool is brought into the drill string towards it operative position until reaching of the output signal is evaluated in respect of its plausibility, in order to increase the safety of the system.

BRIEF DESCRIPTION OF DRAWINGS

The invention will now be described in greater detail by way of embodiments and with reference to the annexed drawings, wherein.

DESCRIPTION OF EMBODIMENTS

Figure 1:
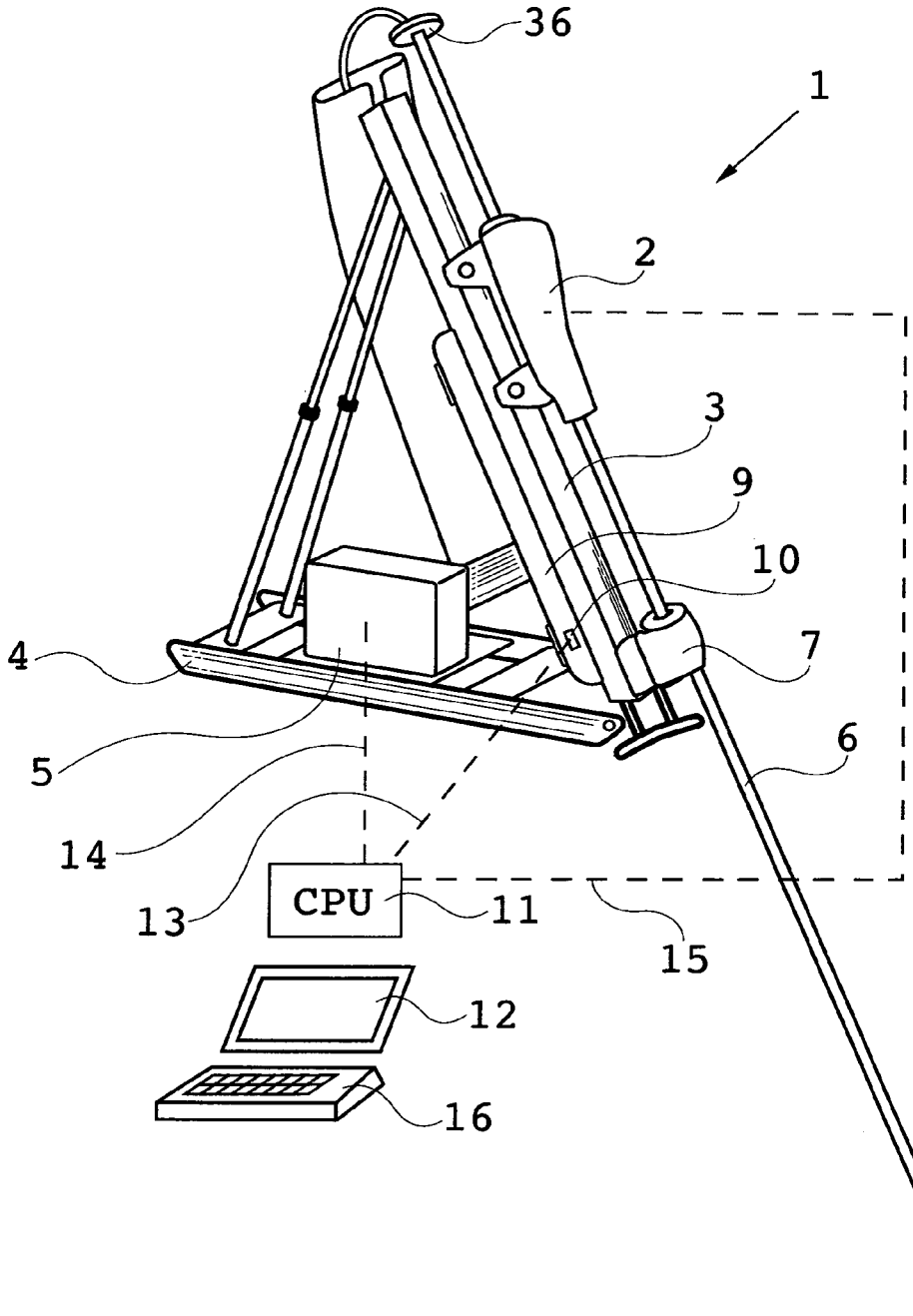
FIG. 1 diagrammatically shows a drill rig for core drilling.

FIG. 1 thus shows a drill rig 1 for core drilling including a drilling machine 2, which is moveable on a feed beam 3 and under feed pressure drives by rotation a tubular drill string 6, which on its distal end in an ordinary manner is provided with a tubular drill bit 8. A drill string support at the end of the feed beam 3 is indicated with 7. A flushing swivel 36 is in a common manner arranged most upwardly on the drill string.

The drill rig 1 has further a rig stand 4 whereon the feed beam 3 is arranged pivotally for allowing a limited adjustment of the drilling angle to the horizontal plane. A power aggregate for power supply to the components of the rig is in general indicated with 5. The feed beam 3 is firmly held on the rig stand 4 over a feed beam support 9, whereon, according to the invention, there is arranged a sensor element 10 for sensing acoustic vibrations in the drill rig.

The sensor element 10 communicates with a CPU 11 over a cable 13. The CPU has suitably stored programs for controlling the components of the drill rig 1 in a per se known manner. For that reason the CPU 11 communicates i.a. with the power aggregate 5 over a cable 14 and with the drilling machine 2 over a cable 15. With 12 is indicated a display for displaying different data related to drilling and with 16 is indicated an input device in the form of keyboard.

Figure 2A:
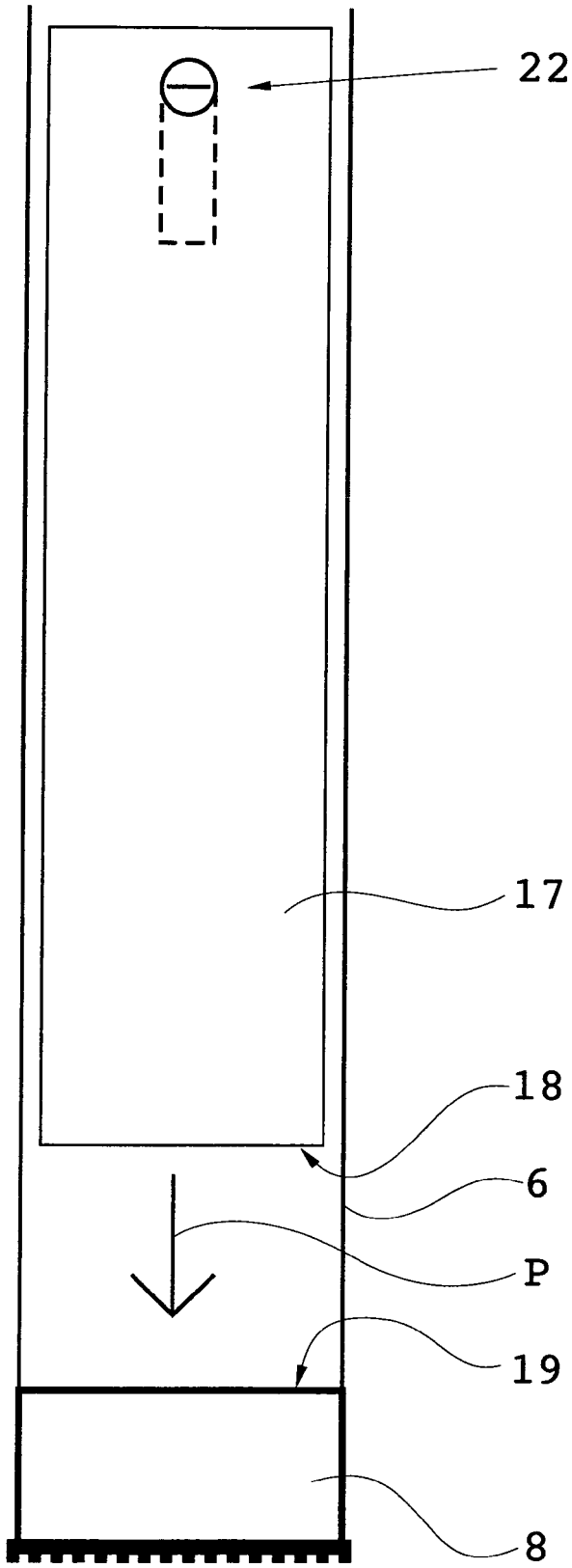
FIG. 2*a* in an axial section shows a detail of a distal part of a drill string with a core retrieving pipe in a first position.

FIG. 2*a* shows in an axial section a core retrieving tool in the form of a tubular core retrieving pipe 17 in a process of being put forward inside the tubular drill string 6 to its operative position, wherein its distal abutment surface 18 will come to abutment against an abutment surface 19 on the drill bit 8 being directed oppositely to a drilling direction. P indicates the forwarding direction, which usually is essentially vertically downwardly, but it is not excluded that this direction P can be directed more sidewards or even upwards depending on the character of the application wherein the rock in question is to be drilled.

Forward driving of the tubular core retrieving pipe 17 can be lowering through the gravitational force acting on the pipe or by flushing down with flushing fluid or water or a combination thereof. With 22 is indicated an area for engagement hooks, which are explained below, and which are intended to co-operate with a catch tool, which is used for pulling out the tubular core retrieving pipe 17 with firmly held core after that a drilling sequence has been completed.

Figure 2B:
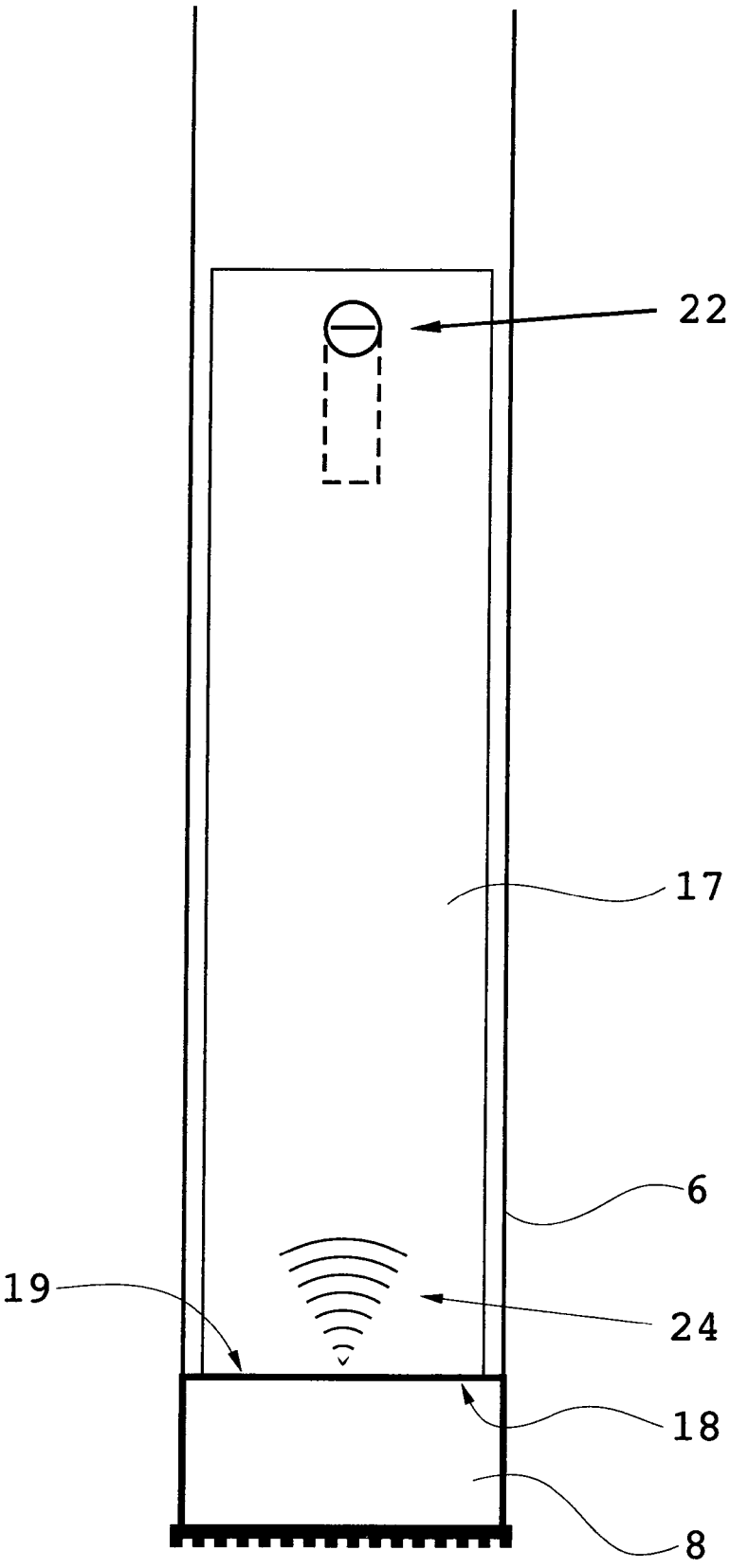
FIG. 2*b* shows the same details as in FIG. 2*a* but in a second position.

FIG. 2*b* shows an operative position when the tubular core retrieving pipe 17 has fulfilled its forwarding movement inside the drill string 6 and with its front edge has come to abutment into an abutment seat intended for that purpose in the region of the drill bit 8. At the occasion of abutment between the abutment surface 18 of the tubular core retrieving pipe 17 against the abutment surface 19 of the drill bit, a sound will be generated, which results in acoustic waves or vibrations, which in FIG. 2*b* are indicated with 24 propagate through the tubular drill string 6 all the way up to the drill rig 1, where they furthermore will propagate further through elements being in contract with the drill string 6 such as the drill string support 7, the drilling machine 2, the feed beam 3 etc as well as to a certain extent to the surroundings.

Thus, the propagated acoustic waves can therefore be sensed by using an acoustic sensor, the sensor element 10 of which (FIG. 1) being positioned on an element in the drill rig 1, which has contact with the tubular drill strings 6.

Figure 3:
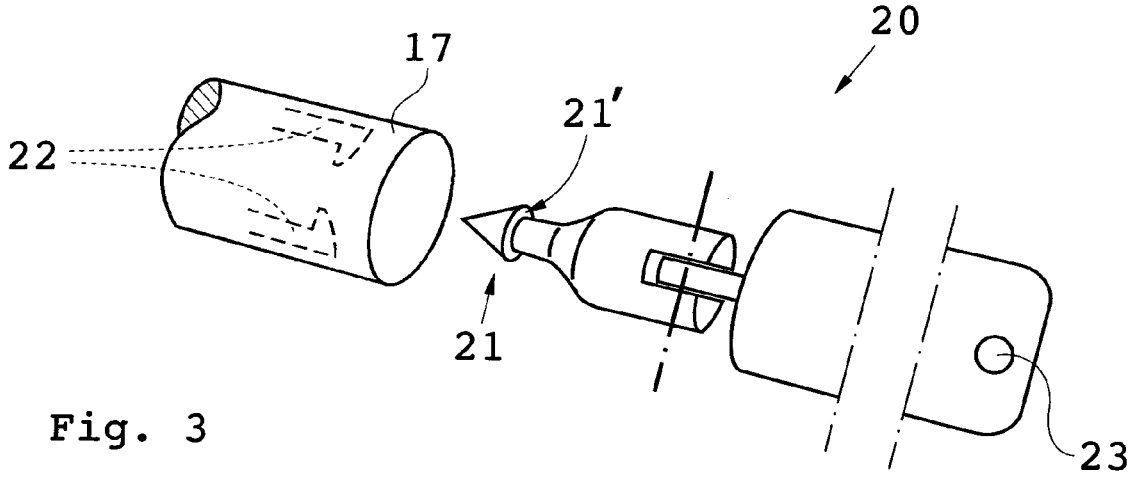
FIG. 3 shows a catch tool at the end of a core retrieving pipe.

In FIG. 3 is shown a catch tool 20 which is intended to be inserted into the drill string in order to, after that a certain length of drilling has been completed, be brought to engagement with the tubular core retrieving pipe 17. By pulling out with an aid of (not shown) pulling line, for which an attachment 23 is arranged on the catch tool 20, the catch tool 20 can be pulled out with firmly held core retrieving pipe 17 and therein a firmly held drill core through the drill string up to the drill rig. There the catch tool can be loosened from the core retrieving pipe and the drilled out and pulled out core be picked up from the core retrieving pipe, whereon the process can be repeated after that a further section has been placed on the proximal end of the drill string in order to make it possible to drill further a chosen distance.

The engagement portion 21 of the catch tool 20 in the present embodiment includes a conical portion having its pointed end directed in the insertion direction and with a transversal base surface 21' such that a hook-shaped end part of the catch tool 20 is being formed. The core retrieving pipe 17 has corresponding engagement hooks 22 which are adapted to co-operate as to engagement with the engagement portion 21 of the catch tool 20.

Figure 4:
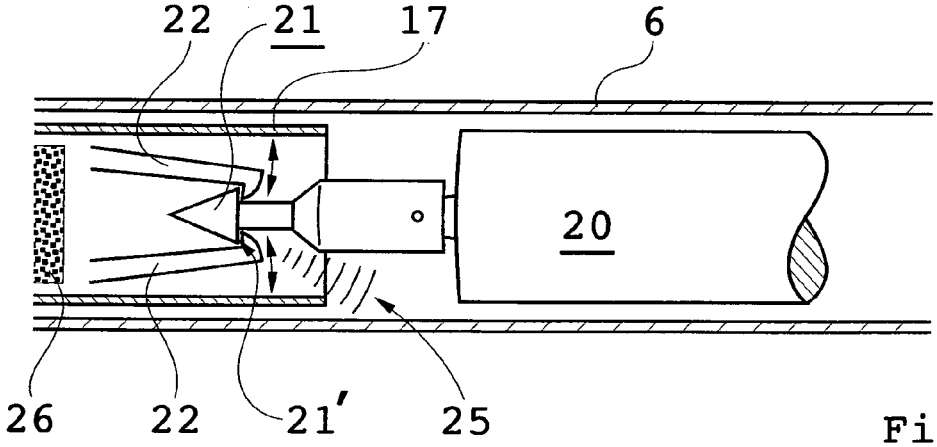
FIG. 4 shows a detail of connecting elements in FIG. 3 in greater scale.

In the axial section shown in FIG. 4 of an area inside the drill string 6, the catch tool 20 with the aid of its engagement portion 21 has come in to engagement co-operation with the core retrieving pipe 17 through its engagement hooks 22. When the engagement portion has come into a position for the co-operation and the engagement hooks 22 has passed the conical portion of the engagement portion 21, the engagement hooks 22 will spring inwardly for establishing engagement co-operation between these parts. Hereby characteristic acoustic vibrations will be generated, when the engagement hooks 22 snaps into the engagement position, said acoustic vibrations being indicated with 25, and will propagate through the drill string 6 on a corresponding manner as is described above with reference to the acoustic vibrations 24 in FIG. 2*b*. 26 indicates a drill core.

According to the invention, acoustic vibrations that prevail in the rig are sensed in order to detect the occurrence of acoustic vibrations being characteristic for on the one hand when the core retrieving pipe reaches its operative position, as is shown in FIG. 2*b*, on the other hand when the catch tool 20 has reached its operative position as is shown in FIG. 4. It has been shown to be possible, by analysing of the acoustic vibrations acting on the sensor element, to detect when such characteristic acoustic vibrations have occurred. Hereby have been stored signals from real events, test and/or calculations of mainly frequency ranges, which are characteristic for these acoustic vibrations.

In the CPU there is suitably for this purpose a filter for filtering away non-relevant frequency ranges and reduce the amount of data intended for computing, and a comparator function, which compares signals from picked-up vibrations with signals stored in the memory. When a match is being established, an output signal is emitted, which is used for example for starting or interrupting an operation or give a signal to the operator. Hereby the entire drilling process can be speeded-up in a secure manner, which gives great economic advantages.

Figure 5:
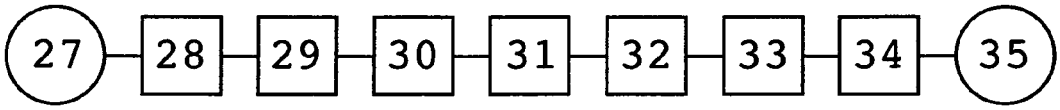
FIG. 5 shows a block diagram for illustrating a method sequence according to the invention.

FIG. 5 shows diagrammatically a block diagram for the illustration of a method sequence according to the invention, wherein:

Position 27 indicates the start of the sequence,

Position 28 indicates initiating of a core retrieving process by inserting and forwarding a core retrieving pipe through a drill string, Position 29 indicates the arrival of the core retrieving pipe to its operative position, wherein characteristic acoustic vibrations are emitted when the core retrieving pipe abuts its seat in the area of the drill bit, Position 30 indicates that sensed acoustic vibrations after analysis are identified as being characteristic for that the core retrieving pipe has reached its operative position, by CPU after analysis of acoustic vibrations, for which the drill rig is subjected, detected acoustic vibrations characteristic for when the core retrieving pipe has reached its operative position, and emitting of a first output signal, Position 31 indicates starting and completing the drilling process a chosen distance, wherein a corresponding long drill core is received inside the core retrieving pipe, Position 32 indicates lowering of a catch tool inside the drill string to its operative position, Position 33 indicates that characteristic acoustic vibrations are occurring when the catch tool reaches its operative position for reasons indicated above, Position 34 indicates that sensed acoustic vibrations after analysis are identified as being characteristic for that the core retrieving pipe has reached its operative position, by the CPU after analysis of acoustic vibrations, for which the drill rig is subjected, detected acoustic vibrations characteristic for when the catch tool has reached its operative position and emitting of a second output signal, and Position 35 indicates ending of the sequence by pulling out the catch tool with hooked-on core retrieving pipe, picking out of the drill core and passing on to position 27.

Figure 6:
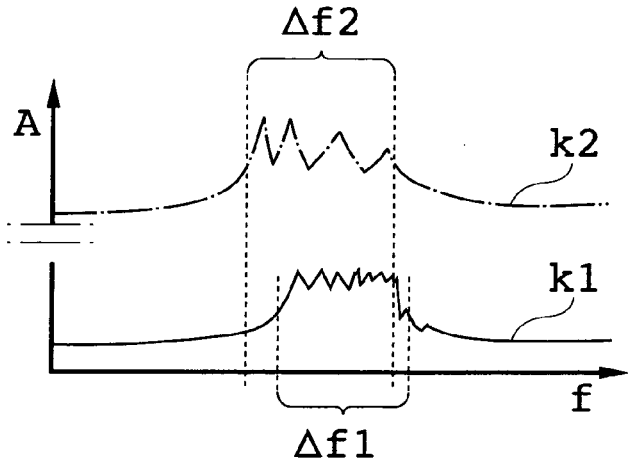
FIG. 6 shows an amplitude—frequency diagram.

In FIG. 6 is diagrammatically shown an amplitude—frequency diagram, wherein are drawn two curves, of which $k_1$ shows a frequency distribution pattern for the event that a core retrieving pipe abuts a seat in the area of a drill bit and $k_2$ which shows a frequency distribution pattern for the event that engagement hooks will come into engagement with an engagement portion on a catch tool. $\Delta f_1$ shows a frequency range, at which characteristic amplitude peaks exist for the first event. $\Delta f_2$ shows a frequency range, wherein amplitude peaks characteristic for the second event occurs. Suitably, the comparison in the CPU is had through comparing acoustic vibrations picked up by the sensor element to frequency patterns in the form of the respective frequency distribution according to FIG. 6.

In practice is has been shown to be suitable in many applications to have one single frequency range, wherein characteristic amplitude peaks for both events occur, wherein these cases one single frequency range can be used for the identification of both these events. It can also be the case that the frequency regions are totally different and that for that reason it is suitable to separate these frequency ranges. It can also be the case to have several frequency ranges for one event.

The invention can be modified within the scope of the following claims. The components included can be constructed otherwise. For example, the core retrieving pipe can be constructed otherwise and elements corresponding to engagement hooks have other forms and function as well as the engagement portion on the catch tool. In FIG. 1 there has been shown a CPU which includes functions to perform the invention. As an alternative, a separate computer such a PC or even a simple computing circuit can be used for that purpose, said PC or circuit only having one cable to a sensor element being positioned on a component in the drill rig and means for alerting the operator that an operative position has been reached.

The analysis device can be integral with the comparator and the CPU, PC and the computing circuit respectively and work digitally or analogously. The signal producer can be a sound, light or vibration generator.

It is preferred that the sensor element of the vibration sensor has contact with a machine part which in turn is in contact with the drill string but it is not excluded to use a sensing device in the form of a free standing microphone for receiving the acoustic vibrations.

The invention claimed is:

1. Method in core drilling, wherein a tubular drill bit (8) being arranged at the end of a tubular drill string (6) is driven under rotation against a material intended for drilling, and wherein for the purpose of core retrieving, a tool (17, 20) is brought inside the drill string to an operative position in the area of the drill bit, characterized in that acoustic vibrations (24, 25) from the drill string are sensed when the tool is brought to its operative position, that sensed acoustic vibrations are analysed for detecting the occurrence of acoustic vibrations characteristic for when the tool has reached its operative position, and that an output signal is emitted when the occurrence of vibrations characteristic of when the tool has reached its operative position has been detected.

2. Method according to claim 1, characterized in that the acoustic vibrations from the drill string (6) are sense over a machine part being connected to the drill string.

3. Method according to claim 1, characterized in that signals received from sensing the acoustic vibrations are compared with signals stored in a memory, which are generated through any one from the group: tests and/or calculations.

4. Method according to claim 1, characterized in that a tubular core retrieving tool (17) in the form of a core retrieving pipe is forwarded inside the drill string (6) to an operative core receiving position adjacent to the drill bit being taken during drilling.

5. Method according to claim 4, characterized in that vibrations characteristic for when the tool has reached its operative position are vibrations emanating from when the tool in the form of the core retrieving pipe (17) reaches an abutment in the drilling position.

6. Method according to claim 1, wherein a core retrieving pipe (17) is adapted for receiving a drill core, characterized in that a catch tool (20) is forwarded to an operative position, where it is connected to the core retrieving pipe (17) for retrieving this with a firmly held drill core (26) from the drilling position after completed drilling.

7. Method according to claim 6, characterized in that the catch tool (20) with connected core retrieving pipe (17) is pulled out from the drill string (6) for taking of the drill core (26).

8. Method according to claim 5, characterized in that vibrations characteristic of when the tool has reached its operative position are vibrations emanating from when the catch tool (20) comes to engagement with the core retrieving pipe (17).

9. Method according to claim 1, characterized in that the output signal is used for one or more from the group: interrupting a step for flushing down a tool (shutting off water pump-drive motor), start drilling, pulling out of a catch tool, producing a signal to be perceived by an operator.

10. Method according to claim 1, characterized in that a time period from initiating that a tool is forwarded inside the drill string towards its operative position until the output signal is received is evaluated in respect of its plausibility.

11. Device in core drilling, wherein a tubular drill bit (8) being arranged at the end of a tubular drill string (6) under rotation is driven against a material intended for drilling, and wherein at least one tool (17, 20) for core retrieving is adapted to be forwarded inside the drill string (6) to an operative postion in the area of the drill bit, characterized by a sensing device (10) for sensing acoustic vibrations from the drill string when the tool is brought to its operative position, an analysing device for analysing sensed acoustic vibrations for detecting the occurrence of acoustic vibrations characteristic of when the tool has reached its operative position, and a signal generator (12) intended to emit an output signal when the occurrence of vibrations characteristic for when the tool has reached its operative position has been detected.

12. Device according to claim 11, characterized in that the sensing device (10) is arranged to sense the acoustic vibrations from the drill string over a machine part which is connected to the drill string.

13. Device according to claim 11, characterized by a comparator for comparing signals received from sensing the acoustic vibrations with signals being stored in a memory, which are generated through any one from the group: tests and/or calculations.

14. Device according to claim 11, characterized in that the tool is a tubular core retrieving tool in the form of a core retrieving pipe (17) for forwarding inside the drill string (6) to a core retrieving operative position adjacent to the drill bit taken during drilling.

15. Device according to claim 14, wherein a core retrieving pipe is adapted for receiving a drill core, characterized in that a catch tool (20) is adapted to be forwarded to an operative position where it is connected to the core retrieving pipe (17), for retrieving this with a firmly held drill core (26) from the drilling position after completed drilling.

16. Device according to claim 15, characterized by an extraction device for pulling out the catch tool (20) with connected core retrieving pipe (17) from the drill string for taking out the drill core.

17. Device according to claim 15, characterized in that vibrations characteristic for when the tool has reached its operative position are vibrations emanating from when the catch tool (20) comes into engagement with the core retrieving pipe (17).

18. Device according to claim 15, characterized in that the output signal is arranged to be used for one or more from the group: interrupting of a step for flushing down a tool (shutting off water pump-drive motor), start drilling, pulling out of a catch tool, generating a signal to be perceived by an operator.

19. Device according to claim 11, characterized by an evaluation device for evaluating a time period from initiating that the tool is forwarded inside the drill string towards its operative position until receiving of the output signal is evaluated in respect of its plausibility.

20. Drill rig including a device according to claim 11.

* * * * *

UNITED STATES PATENT AND TRADEMARK OFFICE

CERTIFICATE OF CORRECTION

PATENT NO. : 8,176,998 B2
APPLICATION NO. : 12/737154
DATED : May 15, 2012
INVENTOR(S) : Johan Brostrom It is certified that error appears in the above-identified patent and that said Letters Patent is hereby corrected as shown below:

Title Page, Section (75) Inventor: Delete "Johan Brostom" and substitute --Johan Brostrom--.

Column 6, Line 46 (Claim 2, Line 2): Delete "sense" and substitute --sensed--.

Column 7, Line 5 (Claim 8, Line 1): Delete "claim 5" and substitute --claim 6--.

Signed and Sealed this
Tenth Day of July, 2012

David J. Kappos

David J. Kappos
*Director of the United States Patent and Trademark Office*